US011168628B2

(12) United States Patent
Wada et al.

(10) Patent No.: US 11,168,628 B2
(45) Date of Patent: Nov. 9, 2021

(54) ENGINE CONTROL DEVICE

(71) Applicant: Mazda Motor Corporation, Hiroshima (JP)

(72) Inventors: Yoshitaka Wada, Hiroshima (JP); Hideaki Yokohata, Hatsukaichi (JP); Yoshiharu Ueki, Hatsukaichi (JP); Kentaro Nomura, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 133 days.

(21) Appl. No.: 16/489,424

(22) PCT Filed: Jan. 29, 2018

(86) PCT No.: PCT/JP2018/002777

§ 371 (c)(1),
(2) Date: Aug. 28, 2019

(87) PCT Pub. No.: WO2018/159184

PCT Pub. Date: Sep. 7, 2018

(65) Prior Publication Data

US 2020/0011256 A1 Jan. 9, 2020

(30) Foreign Application Priority Data

Mar. 3, 2017 (JP) ..... JP2017-040948
Mar. 3, 2017 (JP) ..... JP2017-040950

(51) Int. Cl.
*F02D 41/02* (2006.01)
*F02M 51/06* (2006.01)
(Continued)

(52) U.S. Cl.
CPC ..... *F02D 41/02* (2013.01); *F02D 41/20* (2013.01); *F02M 51/06* (2013.01);
(Continued)

(58) Field of Classification Search
CPC ..... F02D 41/02; F02D 41/20; F02D 41/2096; F02D 41/24; F02D 41/2467;
(Continued)

(56) References Cited

U.S. PATENT DOCUMENTS 6,253,736 B1 * 7/2001 Crofts ..... F02M 47/027 123/467
9,945,317 B2 * 4/2018 Kanbara ..... F02D 41/247
(Continued)

FOREIGN PATENT DOCUMENTS

JP 2005307758 A 11/2005
JP 2011196228 A 10/2011
WO 2013191267 A1 12/2013

*Primary Examiner* — John Kwon
*Assistant Examiner* — Johnny H Hoang
(74) *Attorney, Agent, or Firm* — Alleman Hall Creasman & Tuttle LLP

(57) ABSTRACT

Disclosed is a control device of an engine 1 including an injector. The injector has a needle which is displaced between a close position where no fuel is allowed to flow into a sac portion and an open position where the fuel is allowed to flow into the sac portion. The control device has a fuel injection controller controlling a fuel injection period and an injector controller controlling a motion of the needle. The injector controller executes control to reduce a moving speed of the needle before the needle reaches the closed position when the injection period ends.

8 Claims, 10 Drawing Sheets

(51) Int. Cl.

| | |
|---|---|
| ***F02D 41/20*** | (2006.01) |
| *F02M 51/00* | (2006.01) |
| *F02M 61/10* | (2006.01) |
| *F02M 61/18* | (2006.01) |

(52) U.S. Cl.
CPC ..... *F02D 2200/063* (2013.01); *F02M 51/00* (2013.01); *F02M 61/10* (2013.01); *F02M 61/18* (2013.01)

(58) Field of Classification Search
CPC ..... F02D 2200/063; F02D 2041/2055; F02M 51/00; F02M 51/06; F02M 61/10; F02M 61/18
See application file for complete search history.

(56) References Cited

U.S. PATENT DOCUMENTS

| | | | | |
|---|---|---|---|---|
| 2005/0252494 | A1* | 11/2005 | Rauznitz | F02D 41/2096 123/498 |
| 2010/0219360 | A1 | 9/2010 | Mumford et al. | |
| 2011/0251777 | A1* | 10/2011 | Farah | F02D 41/1401 701/103 |
| 2014/0240886 | A1 | 8/2014 | Itaya et al. | |
| 2017/0191437 | A1* | 7/2017 | Yanoto | F02D 41/20 |
| 2017/0226950 | A1* | 8/2017 | Tanaka | F02D 41/20 |
| 2018/0209373 | A1* | 7/2018 | Yoshiume | F02M 61/10 |
| 2018/0372018 | A1* | 12/2018 | Suenderhauf | F02M 61/166 |
| 2020/0141347 | A1* | 5/2020 | Yanoto | F02D 41/2467 |

* cited by examiner

ENGINE CONTROL DEVICE

TECHNICAL FIELD

The present disclosure relates to an engine control device including an injector injecting fuel in a combustion chamber within a cylinder.

BACKGROUND ART

An injector of this type has fuel injection holes positioned inside a combustion chamber in which combustion takes place. Consequently, solid contents such as carbon generated through combustion adhere to, and accumulate on, the injection holes and their periphery, forming what is called "deposit." This phenomenon may hinder appropriate fuel injection.

The following specifically describes this point with reference to FIG. 1. Illustrations (a) to (c) in FIG. 1 exemplify a tip end portion of an injector of this type exposed in the combustion chamber. A space (referred to as a sac portion 101) into which pressurized fuel flows is formed within the tip end portion of the illustrated injector 100. The sac portion 101 communicates with a combustion chamber 103 via a plurality of injection holes 102.

Disposed within the injector 100 is a needle 104 slidingly displaceable between a close position where no fuel is allowed to flow into the sac portion 101 and an open position where the fuel is allowed to flow into the sac portion 101. The displacement of the needle 104 is controlled at a high speed on the order of milliseconds.

As illustrated in FIG. 1(*a*), during fuel injection, the needle 104 is held at the open position, and the pressurized fuel flows into the sac portion 101. Consequently, the fuel is injected into the combustion chamber 103 via the injection holes 102. As illustrated in an illustration (b) in FIG. 1, when the fuel injection ends, the needle 104 is displaced to the close position. Then, the inflow of the fuel into the sac portion 101 stops, but the fuel left in the sac portion 101 is continuously injected into the combustion chamber 103 due to inertial force.

When the fuel has flowed out of the sac portion 101, the sac portion 101 is placed under negative pressure, and a backflow from the combustion chamber 103 to the sac portion 101 occurs as illustrated in the illustration (c) in FIG. 1. As a result, the deposit is formed at the injection holes 102 and their periphery. The deposit blocks the fuel from flowing, which may cause an improper injection amount and an improper injection state of the fuel.

To address such a problem, Patent Document 1 presents various methods that reduce the backflow to the sac portion.

Specifically, Patent Document 1 proposes a method of lifting the needle again such that only the sac portion is filled with the fuel after the fuel injection ends (Method 1), a method of reducing the closing speed of the needle such that the fuel remains in the sac portion at the end of the fuel injection (Method 2), a method of using a special needle including an outer needle and an inner needle (Method 3), and a method of providing an openable/closable valve outside the openings of the injection holes (Method 4).

An injector operating mechanism has many variations. Among them, Patent Document 1 is directed to an injector for diesel engines employing a needle that opens and closes hydraulically (a float needle) (refer to FIG. 2 of Patent Document 1).

Specifically, a needle 214 of the injector 21 is biased in a closing direction by a spring 216. A control chamber 215 is formed on a basal end side of the needle 214, and a sac portion 220 is formed on a distal end side of the needle 214, into both of which high-pressure fuel is introduced. A relief channel 218 discharging the introduced fuel is connected to the control chamber 215. A solenoid valve 219 opens and closes the relief channel 218.

When the solenoid valve 219 is closed, fuel pressure increases in both of the control chamber 215 and the sac portion 220, and no pressure difference is made between the basal end side and distal end side of the needle 214 Thus, the biasing force of the spring 216 moves the needle 214 in the closing direction. On the other hand, when the solenoid valve 219 is opened, the fuel pressure of the control chamber 215 decreases, and the basal end side of the needle 214 becomes lower in pressure than the distal end side thereof. This moves the needle 214 in an opening direction against the biasing force of the spring 216.

That is to say, the injector 21 of Patent Document 1 controls the motion of the needle 214 using the fuel pressure difference obtained through opening and closing the solenoid valve 219.

CITATION LIST

Patent Document

PATENT DOCUMENT 1: Japanese Unexamined Patent Publication No. 2011-196228

SUMMARY OF THE INVENTION

Technical Problem

Method 1 of Patent Document 1 requires control of the needle motion such that the needle is lifted again after an instructed appropriate amount of fuel is injected and that only the sac portion is filled with the fuel without leaking the fuel to the combustion chamber. However, the volume of the sac portion is small, and ultrafast, high-precision control is required. Moreover, the needle slightly bounces at the moment when the tip end of the needle is seated on a valve seat to be closed. Consequently, in actuality, such needle control is difficult, and the fuel may leak to the combustion chamber to cause a malfunction.

In Method 2, to reduce the closing speed of the needle, the biasing force of the spring needs to be reduced to a certain level For that purpose, opening and closing of the solenoid valve requires adjustment such that constant fuel pressure difference occurs between the basal end side and distal end side of the needle being displaced (while volumes on both sides are changing). Such control is also difficult in actuality.

Methods 3 and 4 involve complicated structure, which may cause another malfunction. Therefore, Methods 3 and 4 are not easy to put into practice.

Further, when the fuel is injected in an intake stroke, fuel injection conditions are set considering a flow within the combustion chamber so that the fuel is sprayed in an optimum state. However, reducing the opening speed of the needle decreases an injection speed. Consequently, the fuel cannot be sprayed in an appropriate state, which may have an influence on fuel economy.

Given these circumstances, an object of the present disclosure is to block a backflow of the fuel into the injector after fuel injection through executing practicable, easy control.

Solution to the Problem

The present disclosure relates to an engine control device including an injector injecting fuel in a combustion chamber within a cylinder.

The injector has a body a tip end portion of which is exposed to the combustion chamber; a sac portion which is a space formed in the tip end portion and into which the fuel flows; an injection hole communicating with the combustion chamber and the sac portion; and a needle slidably disposed within the body to be displaced between a close position where no fuel is allowed to flow into the sac portion and an open position where the fuel is allowed to flow into the sac portion.

The control device includes a fuel injection controller controlling a fuel injection period in accordance with an operating state of the engine, and an injector controller controlling a motion of the needle in accordance with a fuel injection condition set by the fuel injection controller. The injector controller executes slow close control to reduce a moving speed of the needle before the needle reaches the close position when the fuel injection period ends.

That is to say, this control device reduces the moving speed of the needle before the needle reaches the close position when the fuel injection period ends. This allows the needle to be slowly displaced toward the close position, and blocks the sac portion from being placed under negative pressure, thereby leaving the fuel in the sac portion. This also blocks the needle from bouncing.

As a result, a backflow of the fuel from the combustion chamber to the sac portion after fuel injection is reduced, and the deposit is not easily formed at the injection hole and its periphery. Consequently, the fuel can be injected stably over a long term.

In the control device, the slow close control may include executing processing of temporarily stopping the motion of the needle in a period during which the needle is displaced from the open position to the close position.

Temporarily stopping the motion of the needle requires no complicated calculation, and is easily put into practice Since the displacement of the needle is temporarily stopped (the moving speed is substantially zero), the slow close control is executed before the needle reaches the close position.

In the engine control device, the slow close control may include executing processing of setting a speed at which the needle is displaced from the open position to the close position to a predetermined speed, and changing the predetermined speed in accordance with the operating state of the engine.

The speed of the needle is set to the predetermined speed when the needle is at the open position. Thus, the slow close control is executed before the needle reaches the close position. Consequently, even under high-speed control, the motion of the needle is stabilized, and high-precision control can be performed.

In the control device, the operating state of the engine may be the number of revolutions of the engine, and the predetermined speed may be changed to increase with a decrease in the number of revolutions.

In an operating region with the lower number of revolutions of the engine, a weak flow is formed in the combustion chamber. Consequently, when the injection speed of the fuel injected into the combustion chamber decreases, the state of the fuel spray may be affected by the flow. In contrast, such a setting can protect the fuel being sprayed from the adverse effects of the slow close control.

As the injector, an injector driven by current control is preferably used.

That is to say, the injector preferably has: a body a tip end portion of which is exposed to the combustion chamber; a sac portion which is a space formed in the tip end portion and into which the fuel flows; an injection hole communicating with the combustion chamber and the sac portion; a needle slidably disposed within the body to be displaced between a close position where no fuel is allowed to flow into the sac portion and an open position where the fuel is allowed to flow into the sac portion, a spring applying a driving force toward the close position to the needle; and an opening driver applying a driving force toward the open position to the needle upon receiving a current.

The control device includes: a fuel injection controller controlling injection of the fuel in accordance with an operating state of the engine, and an injector controller controlling a current to be supplied to the opening driver in accordance with a fuel injection condition set by the fuel injection controller, and the injector controller supplies an open displacing current for displacing the needle to the open position to the opening driver when a fuel injection period set by the fuel injection controller starts, supplies an open state-holding current for holding the needle at the open position to the opening driver during the injection period, and supplies a speed reduction current for reducing a moving speed of the needle to the opening driver after supply of the open state-holding current is stopped and before the needle reaches the close position when the injection period ends.

Thus, the injector can be operated with good response, and can be stably controlled with high precision even at a high speed on the order of milliseconds.

In that case, the motion of the needle may be temporarily stopped upon receiving the speed reduction current.

In a preferred embodiment, the speed reduction current is larger than the open state-holding current and smaller than the open displacing current.

This enables temporary stop of the needle in a suitable manner, and besides, the just right amount of current can be supplied, which can archive efficient control.

Such slow close control is effective when the fuel is injected in the intake stroke, in which the internal pressure of the combustion chamber is low, rather than in a compression stroke, in which the internal pressure of the combustion chamber is high.

When the injector injects the fuel in the intake stroke, a period during which the motion of the needle is temporarily stopped is preferably shortened with the decrease in the number of revolutions of the engine.

When the motion of the needle is temporarily stopped, the injection speed of the fuel injected into the combustion chamber may decrease at the end of the fuel injection, which may adversely affect the state of the fuel spray. In contrast, such a setting can protect the fuel being sprayed from the adverse effects.

The injector controller may supply the speed reduction current to the opening driver while changing a value of the speed reduction current.

The speed of the needle, even if it is very high, can be freely adjusted through current control, enabling high-precision control.

The speed reduction current may be set smaller than the open displacing current.

This enables reduction of the speed of the needle in a suitable manner, and besides, the just right amount of current can be supplied, which can archive efficient control.

Advantages of the Invention

The disclosed engine control device can practice blocking of a backflow of fuel into an injector after fuel injection. Consequently, the fuel can be injected stably in a combustion chamber over a long term.

DESCRIPTION OF EMBODIMENTS

Embodiments of the present disclosure will be described in detail with reference to the accompanying drawings. Note that the following description is merely exemplary one in nature, and does not limit the present invention, applications, or uses thereof.

First Embodiment

<Engine>

Figure 1:
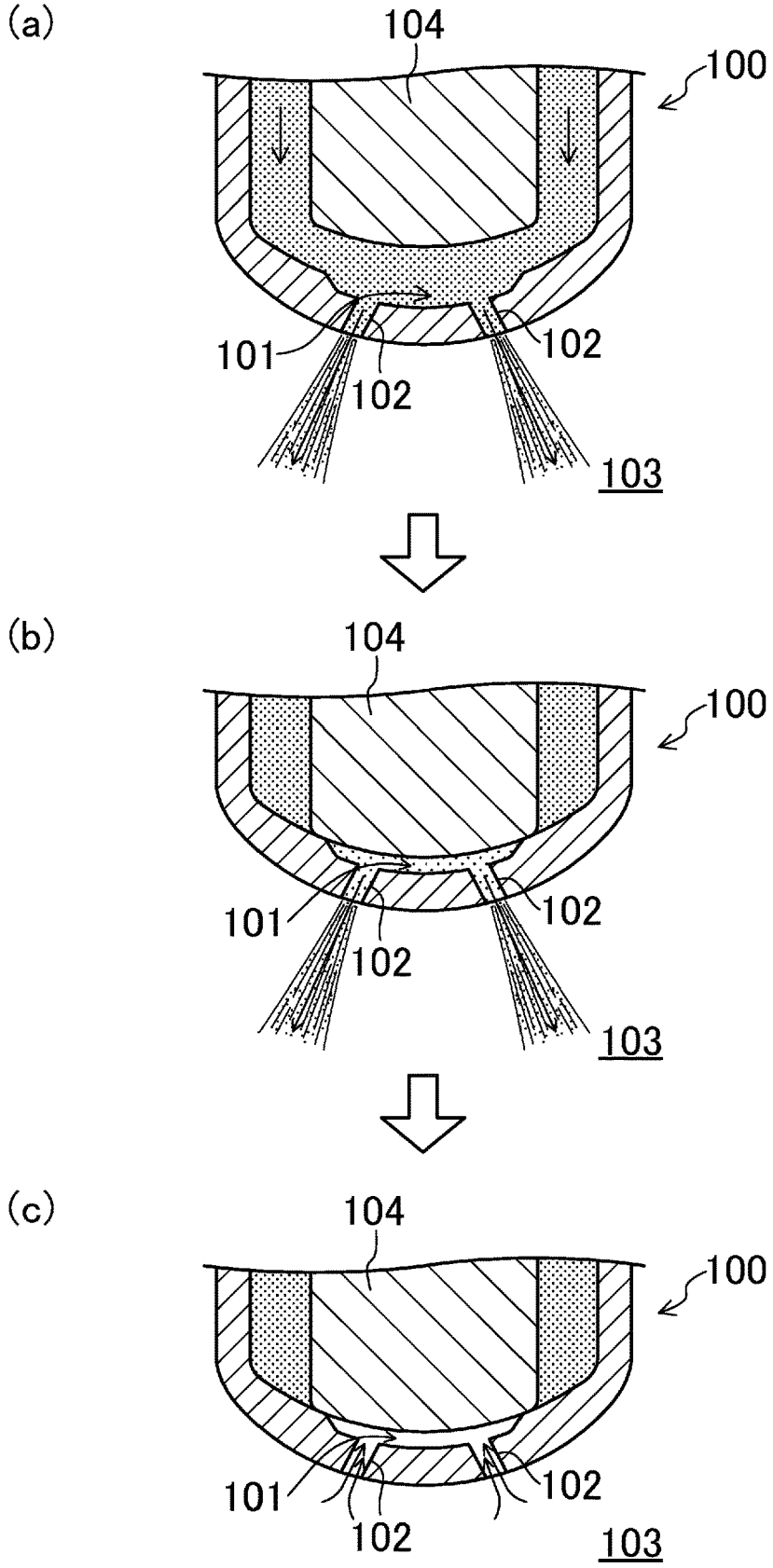
FIG. 1 includes illustrations (a) to (c) that are diagrams illustrating a backflow of fuel into an injector after fuel injection.
Figure 2:
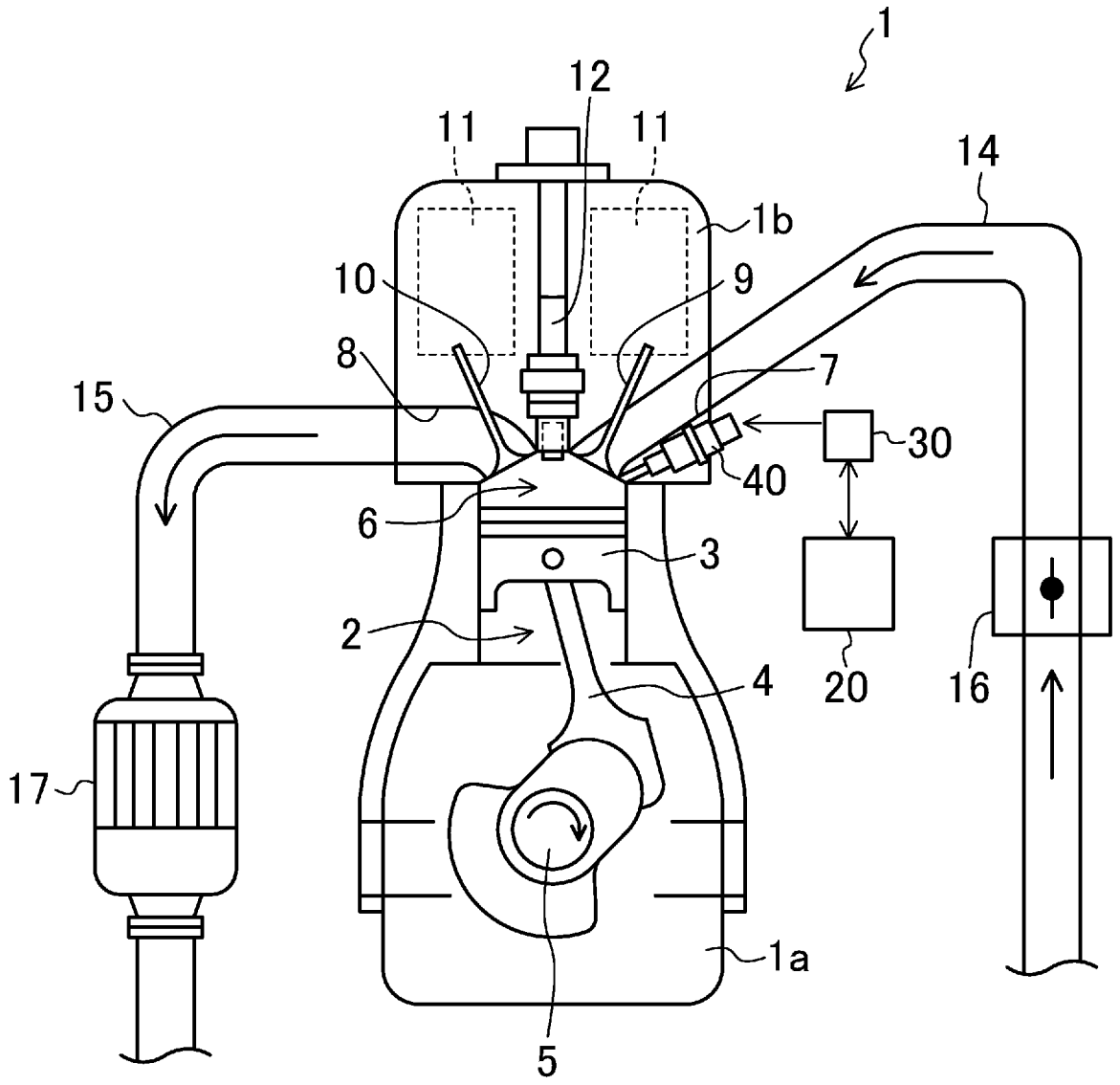
FIG. 2 is a schematic diagram illustrating a configuration of an engine of an embodiment.

FIG. 2 illustrates an engine 1 disclosed in the present embodiment. This engine 1 is a multiple cylinder gasoline engine mounted as a power source on an automobile. Although being the gasoline engine, the engine 1 may use fuel containing gasoline as a main component (e.g., gasoline containing ethyl alcohol).

This engine 1 mainly includes a cylinder block 1*a*, and a cylinder head 1*b* assembled to the top thereof. The cylinder block 1*a* is provided with a plurality of cylindrical cylinders 2 (FIG. 2 illustrates one of them) arranged side by side in a direction orthogonal to the paper of FIG. 2. A piston 3 is inserted into each of the cylinders 2 to be reciprocable. These pistons 3 are coupled to a crankshaft 5 via a connecting rod 4.

The crankshaft 5 rotates in response to the reciprocating motion of these pistons 3 Power obtained by the rotation of the crankshaft 5 is outputted via a transmission (not illustrated). The transmission has a mechanism enabling changes of a gear position (e.g., from a first position to a sixth position). The obtained power is transmitted to wheels with the set gear position. The transmission may be an automatic transmission (what is called AT) or a manual transmission (what is called MT). The type of the transmission of this engine 1 does not matter.

A combustion chamber 6 whose top and bottom are defined by a lower face of the cylinder head 1*b* and an upper face of the piston 3, respectively, is formed in an upper portion of the inside of each of the cylinders 2. Although not illustrated, a cavity (a recess) guiding a flow of the fuel injected into the combustion chamber 6 is formed at the upper face of the piston 3. An intake inlet of an intake port 7 and an exhaust outlet of an exhaust port 8 formed in the cylinder head 1*b* are open in the upper portion of the combustion chamber 6. An intake valve 9 and an exhaust valve 10 opening and closing the intake inlet and the exhaust outlet, respectively, are provided in the cylinder head 1*b*. The number of the intake valve 9 and exhaust valve 10 of the present disclosure does not matter. In this engine 1, each of the cylinders 2 is provided with two intake valves 9 and two exhaust valves 10.

Each of the intake valves 9 and the exhaust valves 10 is driven to open and close in conjunction with the rotation of the crankshaft 5 by valve motion mechanisms 11 installed in the cylinder head 1*b*. The valve motion mechanism includes various mechanisms, such as one with a lift amount and opening/closing timing of the valve fixed, and one with these parameters made variable. The valve motion mechanisms 11 are selected as appropriate in accordance with control of the engine 1.

The cylinder head 1*b* is provided with a spark plug 12 and an injector 40 in each of the cylinders 2. The spark plug 12 has a discharge terminal generating a spark at a tip end thereof. The spark plug 12 is disposed in the cylinder head 1*b* such that the tip end protrudes at a middle portion of the top (a middle portion when viewed in a vertical direction) of the combustion chamber 6.

The injector 40 is a shaft-shaped member injecting the fuel. While the engine 1 is operating, the fuel is supplied to the injector 40 at a predetermined fuel pressure through a fuel supply path (not illustrated). The injector 40 is disposed in the cylinder head 1*b* to extend obliquely downward such that a tip end portion thereof is exposed at a side portion of the top (a side portion viewed in the vertical direction) of the combustion chamber 6 from an intake side. That is to say, this injector 40 is what is called a direct-injection injector, which injects the fuel within the combustion chamber 6 (the details of the structure of the injector 40 will be described later).

An intake channel 14 is connected to an inlet of the intake port 7 opening through one of side faces of the cylinder head 1*b*. Through the intake channel 14 and the intake port 7, outside air (fresh air) is supplied to the combustion chamber 6. An exhaust channel 15 is connected to an outlet of the exhaust port 8 opening through the other side face of the cylinder head 1*b*. Exhaust gas (combustion gas) generated in the combustion chamber 6 is exhausted through the exhaust port 8 and the exhaust channel 15.

The intake channel 14 is provided with an electronically controlled throttle valve 16 which regulates a flow rate of outside air in accordance with an accelerator position (which changes when a driver presses an accelerator pedal). The opening/closing of the throttle valve 16 can be controlled independently of the accelerator position.

The exhaust channel 15 is provided with a catalytic converter 17. The catalytic converter 17 incorporates a three-way catalyst. When the exhaust gas passes through the catalytic converter 17, harmful components (NOx, CO, and HC) in the exhaust gas are purified.

<Control Device>

Operation of the engine 1 is integrally controlled mainly by a powertrain control module (PCM) 20 The PCM 20 receives various pieces of information constantly inputted from various kinds of sensors in order to detect an operating state of the engine 1, for example. Based on the pieces of information, the PCM 20 controls the operation of the valve motion mechanisms 11, the spark plug 12, the throttle valve 16, and the injector 40 appropriately in accordance with the operating state of the engine 1.

Figure 3:
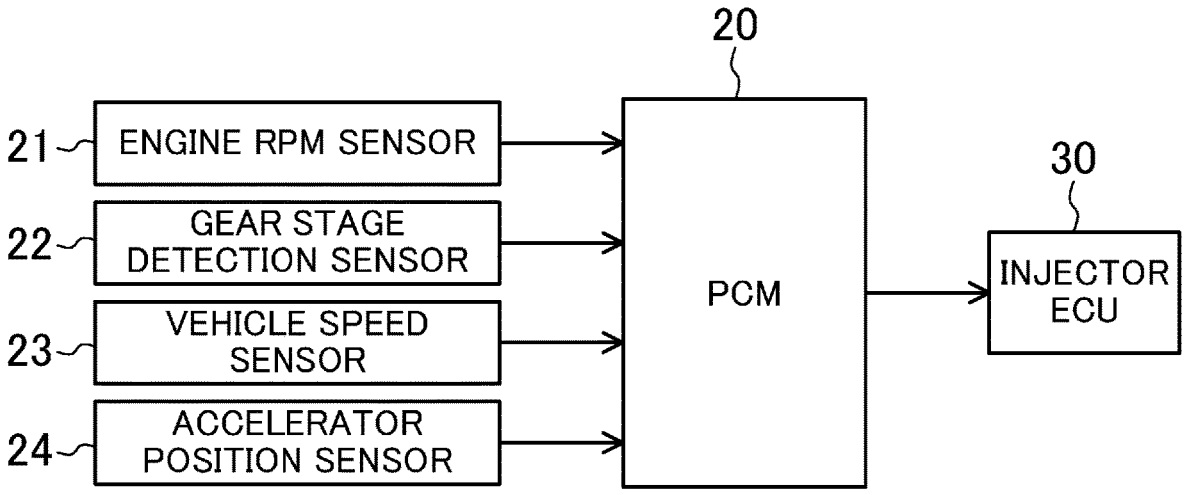
FIG. 3 is a block diagram illustrating control of an injector.

FIG. 3 illustrates a block diagram related to the control of the injector 40. Various sensors are electrically connected to the PCM 20, such as an engine RPM sensor 21, a gear position detection sensor 22, a vehicle speed sensor 23, and an accelerator position sensor 24. The engine RPM sensor 21 detects the number of revolutions of the engine 1. The gear position detection sensor 22 detects a gear position of the transmission. The vehicle speed sensor 23 detects the speed of the automobile. The accelerator position sensor 24 detects an accelerator position. While the engine 1 is operating, pieces of information are constantly inputted to the PCM 20 from these sensors.

The PCM 20 sets a target torque in accordance with the operating state of the engine 1 and an instruction about the output of the engine 1. The PCM 20 outputs the set target torque to an injector ECU 30. Specifically, the PCM 20 determines the state of the number of revolutions of the engine and the state of an engine load based on the pieces of information inputted from these sensors. The PCM 20 then sets a next target torque from the determined states and the accelerator position, and outputs the next target torque to the injector ECU 30.

The injector ECU 30 is a control device attached to the injector 40. The injector ECU 30 has a function tailored to the control of the injector 40. The injector ECU 30 controls a motion of a needle 42, which will be described later, of the injector 40 based on the target torque and the operating state of the engine 1 determined by the PCM 20. Specifically, the injector ECU 30 sets a fuel injection amount corresponding to a set value of the target torque (a required injection amount), and performs control to supply a predetermined current to the injector 40 based on the required injection amount and the operating state of the engine 1.

The injector ECU 30 includes a plurality of maps for control because control is too fast to catch up with by feedback control. These maps include fuel injection patterns corresponding to the engine load and the number of revolutions of the engine. The injector ECU 30 selects one of the maps corresponding to the operating state of the engine 1, and controls the current to be supplied to the injector 40 such that the fuel is injected in accordance with the injection pattern.

Provision of the injector ECU 30 enables an independent calculation related to the fuel injection control. This reduces a processing load on the PCM 20, and enables fuel injection control at a higher speed and with higher precision.

Thus, the engine 1 is configured such that cooperation between the PCM 20 and the injector ECU 30 controls fuel injection, and the injector ECU 30 controls the operation of the injector 40. That is to say, in this engine 1, the PCM 20 and the injector ECU 30 correspond to a "control device." The PCM 20 and the injector ECU 30 constitute a "fuel injection controller," and the injector ECU 30 constitutes an "injector controller." Note that the injector ECU 30 is not essential. The PCM 20 may have the same function as the injector ECU 30, and the PCM 20 alone may constitute the "fuel injection controller."

<Injector>

Figure 4:
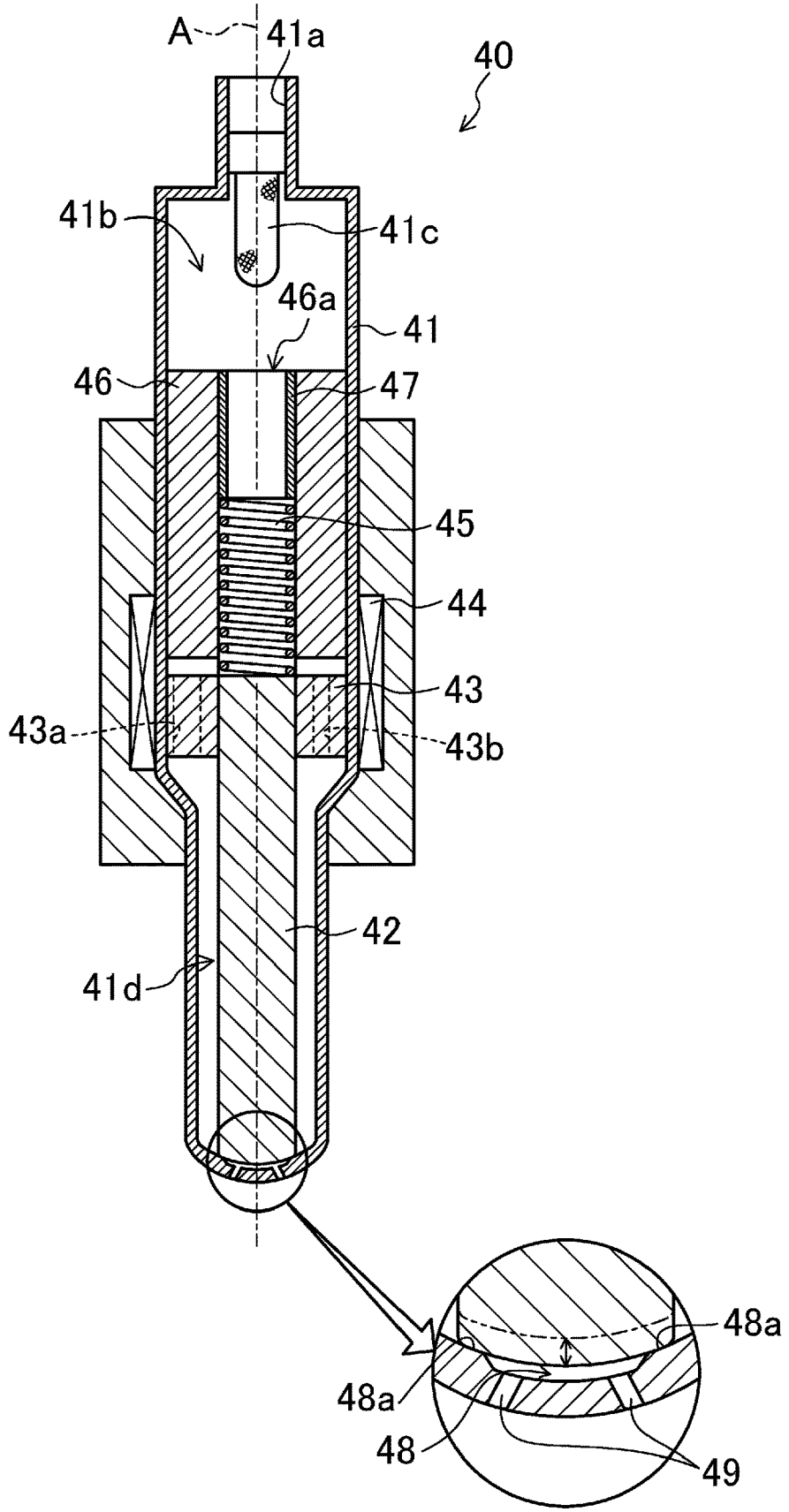
FIG. 4 is a schematic diagram illustrating a structure of the injector.

FIG. 4 specifically illustrates the structure of the injector 40. This injector 40 is a direct-driven multi-hole injector. The injector 40 is configured to be driven by electric control. Specifically, the injector 40 includes a body 41, a needle 42, a core 43, a solenoid coil 44, a coil spring 45, and a connector 46. An opening driver of the present embodiment includes the core 43 and the solenoid coil 44.

The body 41 is a substantially cylindrical shaft-shaped member. The body 41 is generally an assembly of a plurality of parts. The body 41 is attached to the cylinder head 1*b* such that a distal end portion thereof is exposed to the combustion chamber 6. A basal end portion of the body 41 is provided with an inlet 41*a* through which the fuel is introduced, and a basal fuel chamber 41*b* housing the introduced fuel. A strainer 41*c* removing foreign objects is disposed between the inlet 41*a* and the basal fuel chamber 41*b*. The distal end portion of the body 41 is provided with a distal fuel chamber 41*d* with the connector 46 inserted into a middle portion of the space inside the body 41.

The connector 46 is a cylindrical part having a shaft hole 46*a* passing through the center thereof. A cylindrical spring stop 47 is fixed to a basal end portion of the shaft hole 46*a*. The coil spring 45 is inserted into a distal end portion of the shaft hole 46*a*. The basal end of the coil spring 45 is supported by the spring stop 47.

In the distal fuel chamber 41*d*, the shaft-shaped needle 42 and the core 43 fixed to a basal end portion of the needle 42 are disposed so as to receive the distal end of the coil spring 45. The needle 42 and the core 43 are slidable with a predetermined lift amount along a center line A of the injector 40. The needle 42 and the core 43 are biased toward the distal end side by the coil spring 45.

An outer peripheral face of the core 43 is formed to slide along an inner peripheral face of the body 41. A magnet 43*a* is embedded in the outer peripheral face of the core 43. The distal fuel chamber 41*d* is partitioned into a basal end space and a distal end space by the core 43. The core 43 is formed with a liquid channel 43*b* which allows the basal end space and distal end space of the distal fuel chamber 41*d* to communicate with each other.

Consequently, the fuel introduced into the basal fuel chamber 41*b* is also introduced into the distal fuel chamber 41*d* through the shaft hole 46*a* and the liquid channel 43*b*. While the engine 1 is operating, the fuel is supplied to the basal fuel chamber 41*b*, and thus, the basal fuel chamber 41*b* and the distal fuel chamber 41*d* are constantly filled with the fuel of a predetermined fuel pressure.

A sac portion 48 (a space slightly recessed outward) is formed in the distal end portion of the body 41, that is, at a distal end of the distal fuel chamber 41*d*. An annular seat portion 48*a* is provided to surround the sac portion 48. The tip end of the needle 42 is brought into pressure contact with the seat portion 48*a*, thereby liquid-sealing the seat portion 48*a*. A plurality of injection holes 49 is formed at the distal end portion of the body 41. The sac portion 48 communicates with the combustion chamber 6 via the injection holes 49.

The coil spring 45 applies a driving force to the needle 42 such that the needle 42 moves toward a position (close position) where the needle comes into pressure contact with the seat portion 48*a* at its tip end Consequently, unless external force is acted, the sac portion 48 is blocked from the distal fuel chamber 41*d*, and no fuel flows into the sac portion 48.

A solenoid coil 44 is provided outside the body 41 so as to face the core 43 positioned within the body 41. Although not shown, a predetermined amount of current is supplied to the solenoid coil 44 at predetermined timing in accordance with an instruction from the injector ECU 30. When the current is supplied to the solenoid coil 44, a magnetic field is formed, and a magnetic force acts on the magnet 43*a* of the core 43. This magnetic force gives the core 43 a driving force that causes the core 43 to slide toward the basal end against an elastic force of the coil spring 45. The tip end of the needle 42 is lifted away from the seat portion 48*a*, and is directed toward a position where the fuel is allowed to flow into the sac portion 48 (an open position indicated by the dashed-double-dotted curve in the enlarged drawing of FIG. 4).

That is to say, in this injector 40, a predetermined current (a displacing current) is supplied to the solenoid coil 44 to displace the needle 42 to the open position by the action of the magnetic force, the fuel then flows into the sac portion 48, and the fuel injection starts. Then, a predetermined current (an open state-holding current) is supplied to the solenoid coil 44 to hold the needle 42 at the open position, which allows the fuel injection to continue. Then, when the supply of the current to the solenoid coil 44 is stopped, the needle 42 is displaced to the close position by the action of the elastic force of the coil spring 45, the inflow of the fuel into the sac portion 48 stops, and the fuel injection ends.

Consequently, with this injector 40, supplying the current to the solenoid coil 44 immediately opens the valve when the fuel injection starts. Then, stopping the supply of the current to the solenoid coil 44 immediately closes the valve when the fuel injection ends. Consequently, unlike a float injector using fuel pressure difference, the injector 40 can be controlled with almost no time lag. The injector 40 can be stably controlled with high precision even at a high speed on the order of milliseconds or higher.

In general, when the needle 42 is lifted, a force F acting on the needle 42 can be represented by the following expression (1).

$$F=k\cdot x+\Delta P\cdot S-\mathrm{Mag} \quad (1)$$

Here, k represents a spring constant of the coil spring 45, x represents a lift amount, ΔP represents a fuel pressure difference acting on the core 43 toward the close position, S represents an area of the core 43 on which the fuel pressure difference acts, and Mag represents a magnetic force generated by the solenoid coil 44.

Unlike a float injector for diesel engines as disclosed by Patent Document 1, the direct-driven injector 40 for gasoline engines injects the fuel not in the compression stroke, but in the intake stroke. Thus, values k·x and ΔP·S are small. Thus, the injector 40 can be controlled with a relatively small current, which can reduce battery power consumption.

<Fuel Injection Control>

Figure 5:
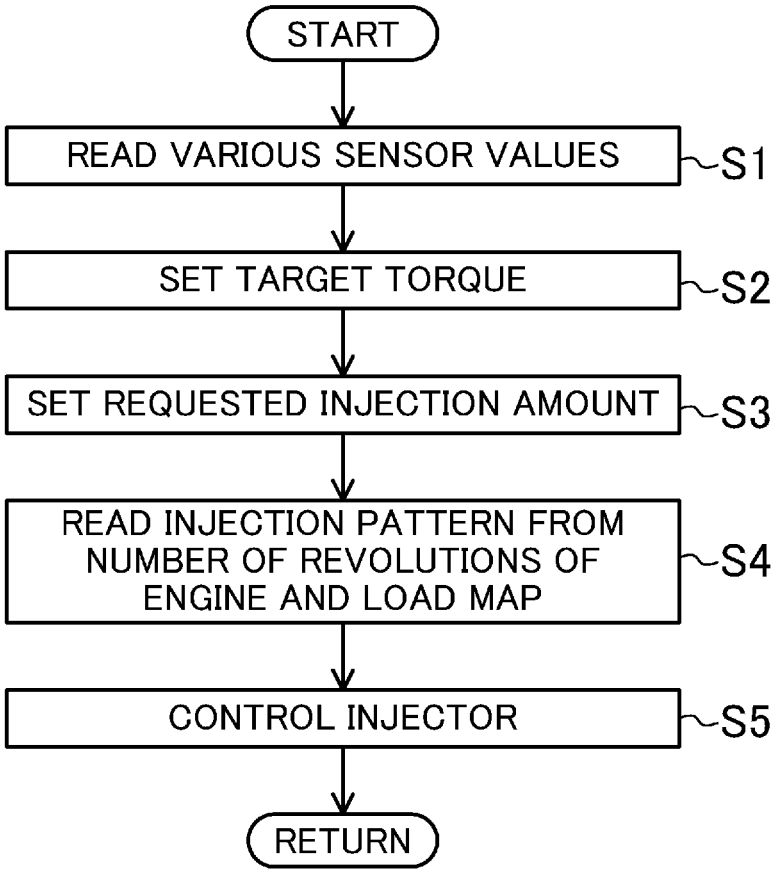
FIG. 5 is a flowchart of fuel injection control.

The following specifically describes fuel injection control with reference to a flowchart in FIG. 5. As illustrated in FIG. 3, the PCM 20 constantly reads values detected by the various sensors to determine the operating state of the engine 1 while the automobile is operating (Step S1). The PCM 20 then sets a target torque for each combustion cycle to bring the engine 1 into a required operating state (Step S2), and outputs the set target torque to the injector ECU 30 together with information on the number of revolutions of the engine and the engine load.

Receiving the information on the target torque from the PCM 20, the injector ECU 30 sets a required injection amount and injection timing corresponding thereto (Step S3). The injector ECU 30 selects a map corresponding to the operating state of the engine 1, that is, the number of revolutions of the engine and the engine load at that time, and reads an injection pattern in the map (Step S4). The injector ECU 30 then performs current control on the injector 40 such that the required injection amount of the fuel is injected based on the injection pattern (Step S5).

Figure 6:
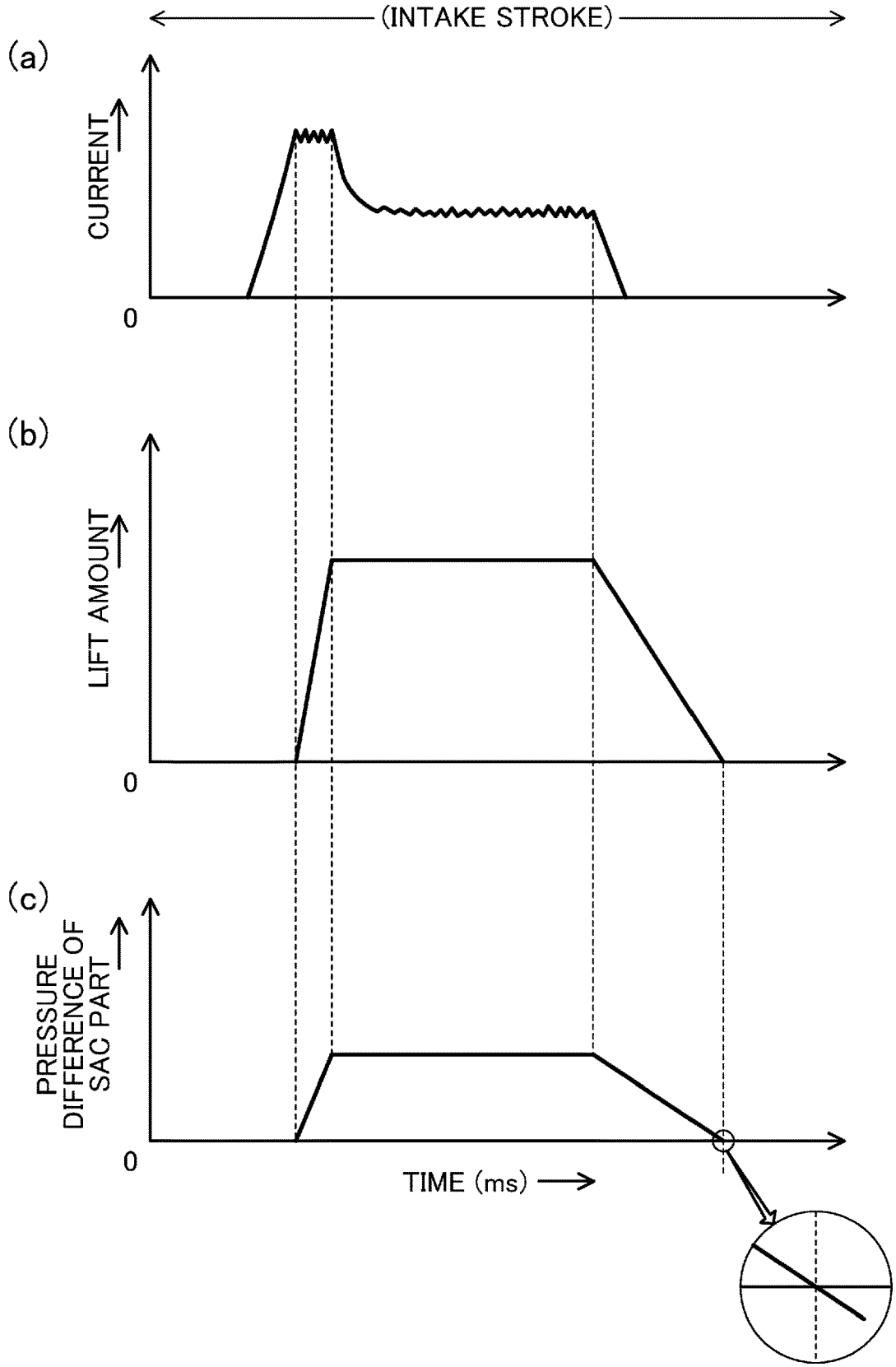
FIG. 6 includes illustrations (a) to (c) that are graphs schematically illustrating an example of an injection pattern in a normal case.

Illustrations (a) to (c) in FIG. 6 schematically illustrate an example of the injection pattern in a normal case. The illustration (a) in FIG. 6 illustrates a change in the current supplied to the solenoid coil 44, the illustration (b) in FIG. 6 illustrates a change in the lift amount of the needle 42, and the illustration (c) in FIG. 6 illustrates a change in the pressure difference of the sac portion 48 ("the internal pressure of the sac portion 48"–"the internal pressure of the combustion chamber 6").

The horizontal axis of each graph indicates time (in the order of millisecond). This engine 1 injects the fuel in the intake stroke. Depending on the injection pattern, injection may be divided into a plurality of times. In this example, the injection is performed at a time.

The point at which the lift amount is "0" corresponds to the close position, and the point at which the lift amount is the maximum corresponds to the open position. A period from when the needle 42 leaves the close position to when the needle 42 returns to the close position again is a fuel injection period set by the PCM 20 and the injector ECU 30 (a period during which the fuel is theoretically injected from the injector 40 to the combustion chamber 6). Consequently, part indicated by a trapezoidal area in the illustration (b) in FIG. 6 corresponds to the required injection amount.

As described above, this injector 40 performs current control to open the valve when the fuel injection starts. This can displace the needle 42 at a high speed, and enables the needle 42 to be lifted with a slight time lag with respect to the injection pattern. That is to say, the opening of the valve can be controlled with high precision. The valve opening operation requires lifting of the needle 42 at a high speed against the coil spring 45 and the fuel pressure. For that purpose, the injector ECU 30 supplies a relatively large current (the displacing current) to the solenoid coil 44.

When the needle 42 reaches the open position, the injector ECU 30 supplies a current smaller than the displacing current (the open state-holding current) to the solenoid coil 44. This operation holds the needle 42 at the open position.

When a predetermined period has passed, the injector ECU 30 stops the supply of the open state-holding current to the solenoid coil 44. This triggers the valve closing operation. In the valve closing operation, the current control allows the coil spring 45 to immediately close the valve. In the valve closing operation, the elastic force of the coil spring 45 displaces the needle 42. Thus, the needle 42 is displaced at a lower speed than in the valve opening operation (gentler in slope).

When the needle 42 reaches the close position, the injection period ends, and the fuel injection stops. At that time, the inflow of the fuel into the sac portion 48 stops. However, as illustrated in an enlarged scale in the illustration (c) in FIG. 6, the fuel in the sac portion 48 is continuously injected into the combustion chamber 6 by the action of inertial force. This places the sac portion 48 under negative pressure.

In the intake stroke, in particular, the internal pressure of the combustion chamber 6 is low, unlike the compression stroke. For this reason, the fuel easily flows out, and the sac portion 48 is more easily brought into negative pressure.

Therefore, after the end of the injection period (after the needle 42 has reached the close position), burned gas (containing carbon) left in the combustion chamber 6 in the immediately preceding exhaust stroke flows back to the sac portion 48, which may generate deposit at the injection holes 49 and its periphery.

(Temporary Stop Control)

Under these circumstances, this engine 1 is configured to reduce the possibility that the sac portion 48 is placed under negative pressure, which can occur after the end of fuel injection. Specifically, using the injector 40 having good response, the motion of the needle 42 is temporarily stopped immediately before the needle 42 reaches the close position in the valve closing operation when the injection period ends.

Specifically, after the supply of the open state-holding current is stopped and the valve closing operation starts, and immediately before the needle 42 reaches the close position, the injector ECU 30 supplies a temporary stop current for temporarily stopping the motion of the needle 42 to the solenoid coil 44. The term "temporary stop" referred to in this section designates not only the case where the needle 42 completely stops its motion, but also the case where the needle 42 reduces its speed to the extent it stops the motion. To sum up, only required is to give an opposite driving force to the needle 42 to block the displacement of the needle 42 such that the sac portion 48 is not brought into negative pressure. That is to say, the temporary stop control is an example of slow close control which will be described later.

Figure 7:
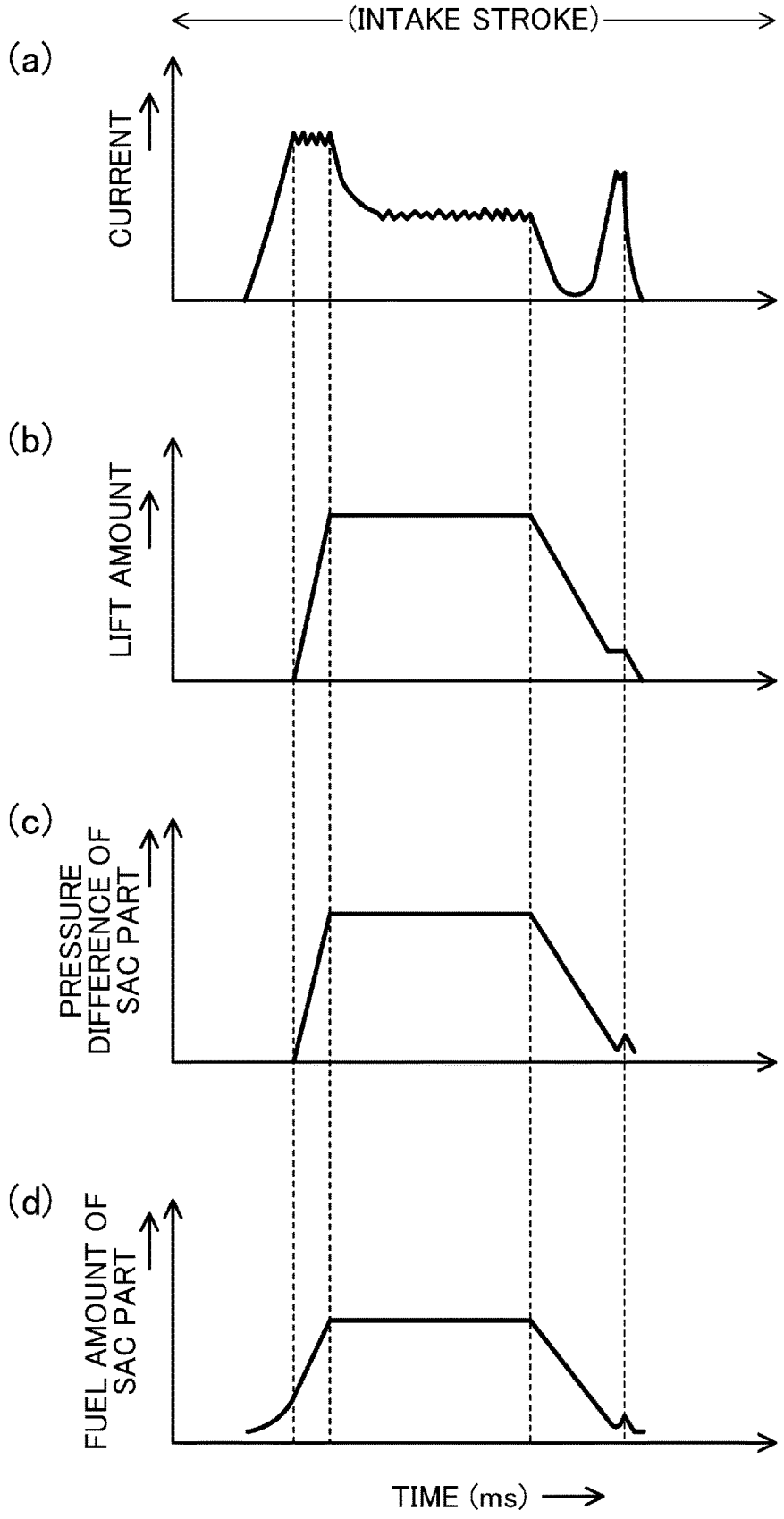
FIG. 7 includes illustrations (a) to (d) that are graphs schematically illustrating an example of an injection pattern when temporary stop control is performed.

Illustrations (a) to (d) in FIG. 7 exemplify an injection pattern when the temporary stop control is performed. The illustration (a) in FIG. 7 illustrates a change in the current supplied to the solenoid coil 44, the illustration (b) in FIG. 7 illustrates a change in the lift amount of the needle 42, the illustration (c) in FIG. 7 illustrates a change in the pressure difference of the sac portion 48, and the illustration (d) in FIG. 7 illustrates a change in the fuel amount in the sac portion 48.

As illustrated in the illustration (a) in FIG. 7, after the normal injection period ends and the supply of the open state-holding current is stopped, a temporarily stopping current is supplied to the solenoid coil 44 to temporarily stop the motion of the needle 42 again. The temporarily stopping current is only required to temporarily stop the needle 42, and thus, is preferably set to be a current that is larger than the open state-holding current and is smaller than the displacing current.

Since the sac portion 48, which is a minute space, is targeted, the needle 42 preferably temporarily stops at timing immediately before reaching the close position during the valve closing operation. Supply of the temporarily stopping current to the solenoid coil 44 blocks the displacement of the needle 42, and as illustrated in the illustration (b) in FIG. 7, a small lift amount of the needle 42 is held immediately before reaching the close position. Consequently, the needle 42 to be seated on the valve seat is displaced slowly, and as illustrated in illustrations (c) and (d) in FIG. 7, the fuel remains in the sac portion 48, blocking the sac portion 48 from becoming negative in pressure. This also blocks the needle 42 from bouncing.

As a result, a backflow of the fuel from the combustion chamber 6 to the sac portion 48 after fuel injection is reduced, and the deposit is not easily formed at the injection hole 49 and its periphery. Thus, appropriate fuel injection can be performed stably over a long term. Temporarily stopping the needle 42 is a simple operation requiring no complicated calculation, and can reduce a processing load on the injector ECU 30.

(Influence of Number of Engine Revolutions and Engine Temperature)

When such temporary stop control is performed, an injection speed of the fuel injected into the combustion chamber 6 may decrease at the end of the fuel injection.

When the fuel is injected in the intake stroke, fuel injection conditions are set so that the fuel is sprayed in an optimum state in order to control a combustion state. For example, the injection timing and the shape of a cavity of the piston 3 are combined to generate a predetermined flow such as a tumble flow or a swirl flow in the combustion chamber 6 so as to allow the fuel to be sprayed in the optimum state. Given this situation, when the injection speed of the fuel decreases, the fuel cannot be sprayed in the optimum state, which may have an influence on fuel economy and the like.

In an operating region with a lower number of revolutions of the engine, in particular, the flow formed in the combustion chamber 6 is weaker than that in an operating region with a higher number of revolutions of the engine. For this reason, the state of the fuel spray is easily influenced by the flow. Given these circumstances, this engine 1 is configured to reduce a period during which the needle 42 temporarily stops moving with the decrease in the number of revolutions of the engine.

Figure 8:
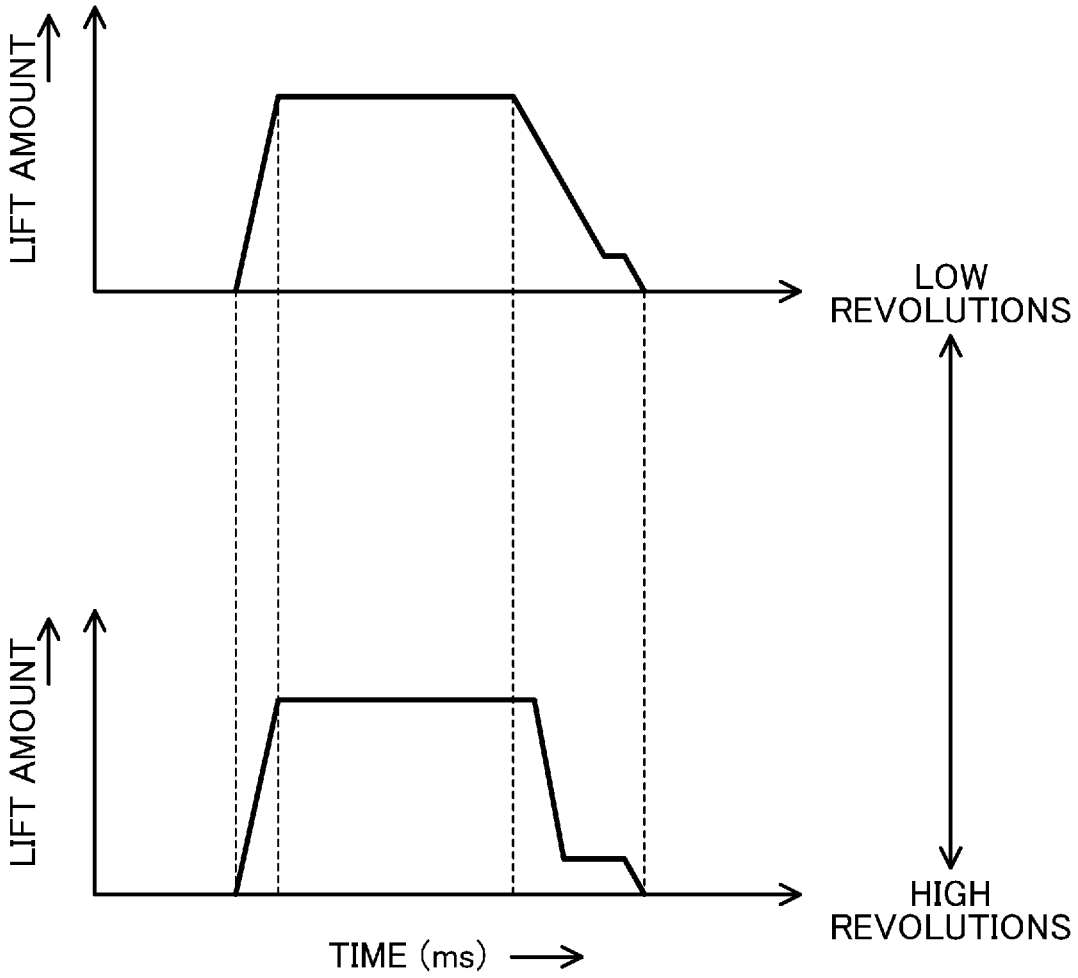
FIG. 8 is a graph illustrating control considering the number of revolutions of an engine.

Specifically, as illustrated in FIG. 8, in the operating region with a higher number of revolutions of the engine, time during which the temporarily stopping current is supplied to the solenoid coil 44 is set to be longer such that time during which the needle 42 temporarily stops moving becomes relatively long. In the operating region with a lower number of revolutions of the engine, the time during which the temporarily stopping current is supplied to the solenoid coil 44 is set to be shorter such that the time during which the needle 42 temporarily stops relatively reduces.

This can protect the fuel being sprayed from adverse effects of the temporary stop control.

The injector ECU 30 adjusts the timing at which the open state-holding current is stopped, and the displacement speed of the needle 42 in the valve closing operation, such that the required injection amount is kept constant without changing the injection period. The injector 40, which is electrically controlled, can perform such adjustment.

Similarly, the fuel being sprayed can also be influenced by engine temperature. Specifically, when the engine temperature is low, the fuel sprayed in the combustion chamber 6 is hard to vaporize. For this reason, when the injection speed of the fuel decreases, the fuel cannot be sprayed in the optimum state, which may have an influence on fuel economy and the like.

Given these circumstances, in a preferred embodiment, the period during which the needle 42 temporarily stops moving decreases with the decrease in the engine temperature and the number of revolutions of the engine. A possible setting is, for example, switching the length of the period during which the needle 42 temporarily stops moving before and after completion of what is called warming up for raising the engine temperature to a predetermined temperature after cold startup.

Second Embodiment

A second embodiment exemplifies the case in which the slow close control is performed, i.e., the moving speed of the needle 42 is lowered so as not to generate negative pressure in the sac portion 48, which can occur after the end of fuel injection. The engine 1 and other components have the same structure as those of the first embodiment. Thus, like reference characters designate identical or corresponding components in the drawings, and description thereof may not be repeated.

(Slow Close Control)

The engine 1 of the second embodiment is configured to reduce the speed of the needle 42 displaced from the open position to the close position when the injection period ends.

Specifically, when the supply of the open state-holding current is stopped and the valve closing operation starts, the needle 42 of the first embodiment is displaced toward the close position at a constant speed by the driving force generated by the elasticity of the coil spring. In contrast, in the engine 1 of the second embodiment, the injector ECU 30 supplies a speed reduction current for reducing the speed of the needle 42 to the solenoid coil 44.

Figure 9:
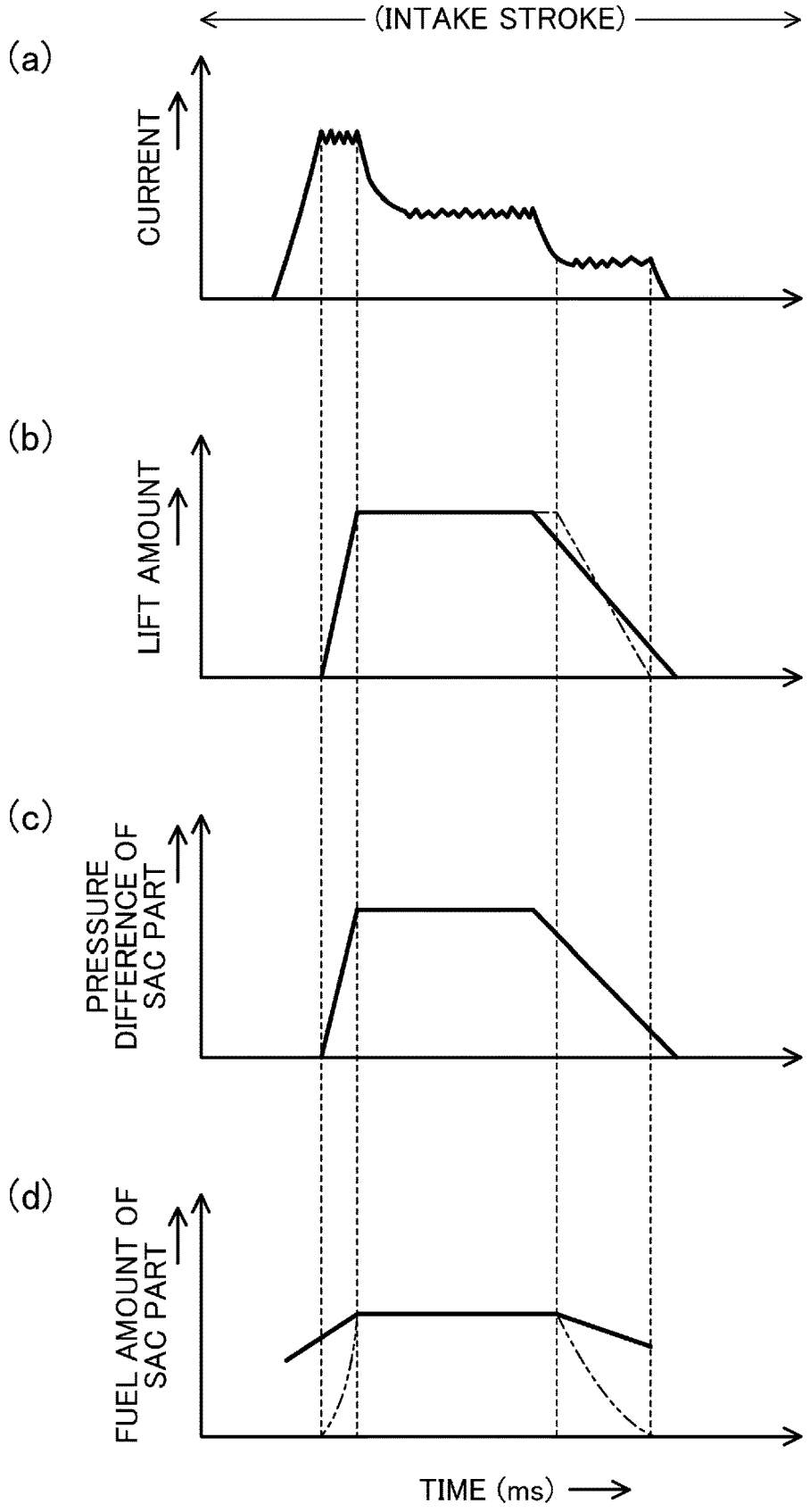
FIG. 9 includes illustrations (a) to (d) that are graphs schematically illustrating an example of an injection pattern when slow close control is performed.

Illustrations (a) to (d) in FIG. 9 exemplify an injection pattern when the slow close control is performed. The illustration (a) in FIG. 9 illustrates a change in the current supplied to the solenoid coil 44, the illustration (b) in FIG. 9 illustrates a change in the lift amount of the needle 42, the illustration (c) in FIG. 9 illustrates a change in the pressure difference of the sac portion 48, and the illustration (d) in FIG. 9 illustrates a change in the fuel amount in the sac portion 48.

As illustrated in the illustration (a) in FIG. 9, when the normal injection period ends and the supply of the open state-holding current is stopped, the speed reduction current is supplied to the solenoid coil 44. The speed reduction current is only required to reduce the speed of the needle 42 to a predetermined value against the driving force of the coil spring, and thus, is a current smaller than the displacing current. The magnitude of the speed reduction current is adjusted in accordance with a speed reduction amount.

Adjusting the magnitude of the speed reduction current can give an opposite driving force of a desired magnitude against the driving force of the coil spring to the needle. Consequently, the displacement speed of the needle can be freely adjusted. Further, through current control, the adjustment can be made with high precision.

The injector ECU 30 adjusts the timing at which the open state-holding current is stopped in accordance with the reduced displacement speed such that the required injection amount is made constant. Electric control enables such adjustment. Even when the displacement speed is made variable, the required injection amount can be maintained with high precision.

In a preferred embodiment, the speed reduction current is a constant value. This is because the control is performed at a high speed on the sac portion 48, which is a minute space, making the speed reduction current variable during closing of the valve complicates the control, increasing a processing load. When the speed reduction current is a constant value, the motion of the needle is stabilized, and the control can be performed with higher precision.

Thus, the needle is displaced at a constant displacement speed which is made lower than a displacement speed under the driving force generated by the coil spring alone, which is indicated by a virtual line in the illustration (b) in FIG. 9. Consequently, the needle 42 is slowly displaced to be seated on the valve seat, and the fuel remains in the sac portion 48. This can block the sac portion 48 from being placed under negative pressure as illustrated in the illustrations (c) and (d) in FIG. 9. This also blocks the needle 42 from bouncing.

As a result, a backflow of the fuel from the combustion chamber 6 to the sac portion 48 after the fuel injection is reduced, and the deposit is not easily formed at the injection holes 49 and their periphery. Thus, appropriate fuel injection can be performed stably over a long term. Reducing the speed of the needle 42 is a simple operation requiring no complicated calculation, and can reduce a processing load on the injector ECU 30.

(Influence of Operating State of Engine)

When such slow close control is performed, an injection speed of the fuel injected into the combustion chamber 6 may decrease at the end of the fuel injection, just like when the temporary stop control is performed. When the injection speed of the fuel decreases, the fuel cannot be sprayed in the optimum state, which may have an influence on fuel economy and the like. In the operating region with a lower number of revolutions of the engine, the state of the fuel spray is easily influenced by the flow.

Given these circumstances, the engine 1 of the second embodiment is configured to increase the displacement speed of the needle 42 with the decrease in the number of revolutions of the engine.

Figure 10:
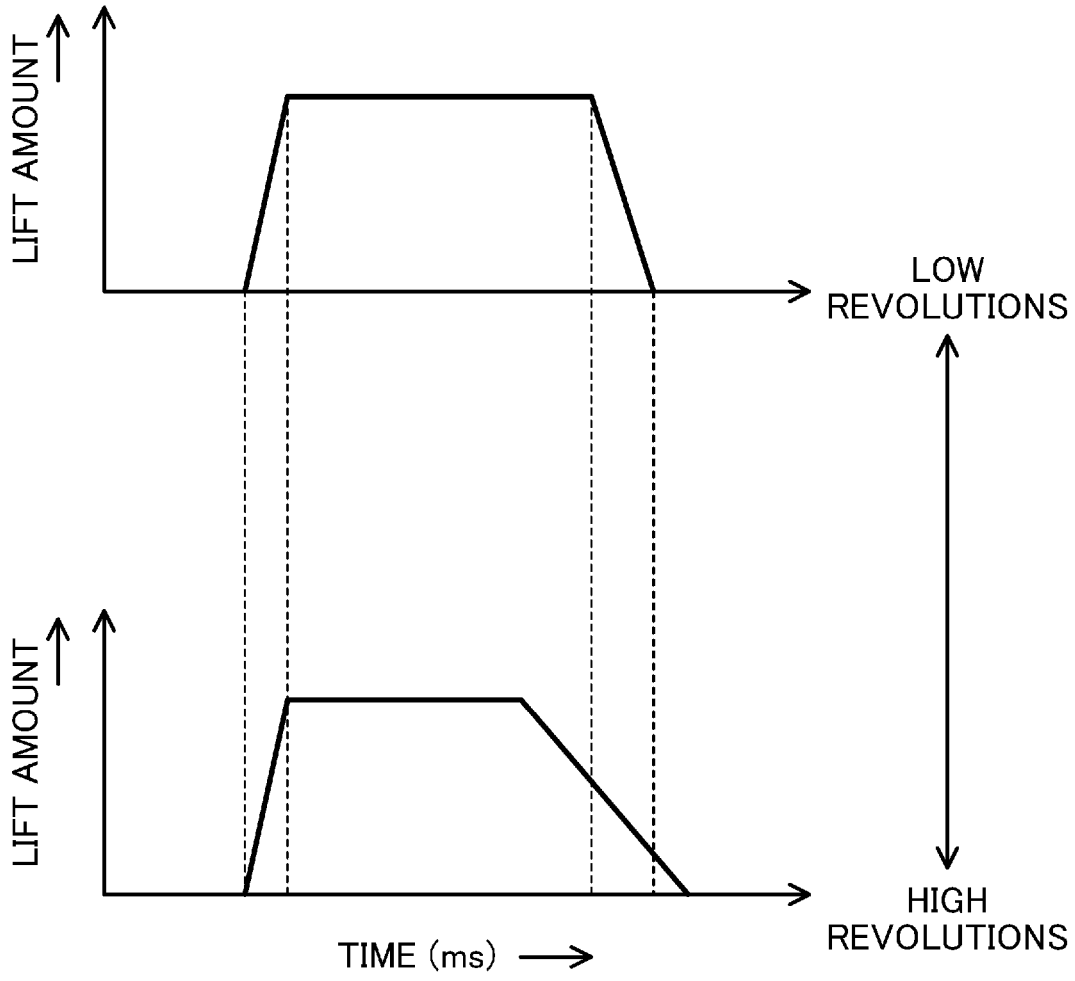
FIG. 10 is a graph illustrating control considering an operating state of an engine.

Specifically, as illustrated in FIG. 10, in the operating region with a higher number of revolutions of the engine, the value of the speed reduction current supplied to the solenoid coil 44 is set to be larger such that the displacement speed of the needle 42 relatively decreases (gentler in slope). In the operating region with a lower number of revolutions of the engine, the value of the speed reduction current supplied to the solenoid coil 44 is set to be smaller such that the displacement speed of the needle 42 relatively increases (steeper in slope).

This can protect the fuel being sprayed from adverse effects of the slow close control.

In the engine 1 of the second embodiment, just like in the engine 1 of the first embodiment, the fuel cannot be sprayed in the optimum state when the injection speed of the fuel decreases at low engine temperature, which may have an influence on fuel economy and the like.

Thus, in a preferred embodiment, the engine 1 of the second embodiment is configured to relatively increase the displacement speed of the needle 42 with the decrease in the engine temperature and the number of revolutions of the engine. A possible setting is, for example, switching the magnitude of the displacement speed of the needle 42 before and after completion of what is called warming up for raising the engine temperature to a predetermined temperature after cold startup.

The engine control device is not limited to those described in the above embodiments, and may include various other configurations.

Although the embodiments have taken a gasoline engine performing fuel injection in the intake stroke as an example, the present invention can also be applied to diesel engines performing fuel injection in the compression stroke.

The number of stops in the temporary stop control is not limited to one. The temporary stop control may be performed a plurality of times during the valve closing operation.

When the fuel injection is divided in a plurality of times, the temporary stop control and the slow close control are preferably performed only in the last fuel injection.

In the engine 1 of the second embodiment, the displacement speed of the needle 42 can be decreased and increased Current control enables such decrease and increase.

DESCRIPTION OF REFERENCE CHARACTERS

1 Engine
2 Cylinder
3 Piston

6 Combustion chamber
12 Spark plug
20 PCM (Control Device)
30 Injector ECU (Control Device)
40 Injector
41 Body
42 Needle
48 Sac Portion
49 Injection Hole

The invention claimed is:

1. An engine control device comprising:
an injector injecting fuel in a combustion chamber within a cylinder,
the injector having:
a body;
a tip end portion of the body which is exposed to the combustion chamber;
a sac portion which is a space formed in the tip end portion and into which the fuel flows;
an injection hole communicating with the combustion chamber and the sac portion; and
a needle slidably disposed within the body to be displaced between a close position where no fuel is allowed to flow into the sac portion and an open position where the fuel is allowed to flow into the sac portion,
wherein
the control device includes:
a fuel injection controller configured to control the injector to perform fuel injection during a fuel injection period in accordance with an operating state of the engine, and
an injector controller controlling a motion of the needle by supplying a current to a solenoid coil of the injector in accordance with a fuel injection condition set by the fuel injection controller, the current including an open displacing current, an open state-holding current, and a temporary stop current,
wherein
the injector controller supplies the open displacing current to increase a lift amount of the needle,
the injector controller supplies the open state-holding current to hold the needle at the open position after supplying the open displacing current, the open state-holding current being smaller than the open displacing current,
the injector controller supplies the temporary stop current to hold the lift amount of the needle at a predetermined amount that is smaller than a maximum lift amount in the open position, when the fuel injection period ends after supplying the open state-holding current, the temporary stop current being larger than the open state-holding current, and
the injector controller reduces the current to zero after the temporary stop current is supplied, thereby causing the needle to reach the close position.

2. The engine control device of claim 1, wherein
the injector injects the fuel in an intake stroke.

3. The engine control device of claim 1, wherein
the injector injects the fuel in an intake stroke, and a period during which the motion of the needle is temporarily stopped is shortened with the decrease in the number of revolutions of the engine.

4. The engine control device of claim 1, wherein
the fuel injection is divided into a plurality of times including a last fuel injection, and the supply of the temporary stop current to hold the lift amount of the needle at the predetermined amount is performed only in the last fuel injection.

5. An engine control device comprising:
an injector injecting fuel in a combustion chamber within a cylinder through current control,
the injector having:
a body a tip end portion of which is exposed to the combustion chamber;
a sac portion which is a space formed in the tip end portion and into which the fuel flows;
an injection hole communicating with the combustion chamber and the sac portion;
a needle slidably disposed within the body to be displaced between a close position where no fuel is allowed to flow into the sac portion and an open position where the fuel is allowed to flow into the sac portion,
a spring configured to apply a driving force toward the close position to the needle; and
an opening driver including a solenoid coil, configured to apply a driving force toward the open position to the needle upon receiving a current,
wherein
the control device includes
a fuel injection controller controlling injection of the fuel in accordance with an operating state of the engine, and
an injector controller controlling a current to be supplied to the opening driver in accordance with a fuel injection condition set by the fuel injection controller, the current including an open displacing current, an open state-holding current, and a speed reduction current, and
the injector controller
supplies the open displacing current to the opening driver to displace the needle to the open position by increasing a lift amount of the needle when a fuel injection period set by the fuel injection controller starts,
supplies the open state-holding current for holding the needle at the open position after supplying the open displacing current during the injection period, the open state-holding current being smaller than the open displacing current, and
supplies the speed reduction current for reducing a moving speed of the needle after supply of the open state-holding current is stopped and before the needle reaches the close position when the injection period ends, while changing the current, the speed reduction current being larger than the open state-holding current and smaller than the open displacing current.

6. The engine control device of claim 5, wherein
the fuel injection is divided into a plurality of times including a last fuel injection, and the supply of the speed reduction current for reducing the moving speed of the needle is performed only in the last fuel injection.

7. An engine control device comprising:
an injector injecting fuel in a combustion chamber within a cylinder,
the injector having:
a body;
a tip end portion of the body which is exposed to the combustion chamber;
a sac portion which is a space formed in the tip end portion and into which the fuel flows;

an injection hole communicating with the combustion chamber and the sac portion; and a needle slidably disposed within the body to be displaced between a close position where no fuel is allowed to flow into the sac portion and an open position where the fuel is allowed to flow into the sac portion, wherein the control device includes:

a fuel injection controller controlling a fuel injection period in accordance with an operating state of the engine, and an injector controller controlling a motion of the needle by supplying a current to a solenoid coil of the injector in accordance with a fuel injection condition set by the fuel injection controller, the current including an open displacing current, and an open state-holding current, wherein the injector controller supplies the open displacing current to increase a lift amount of the needle, the injector controller supplies the open state-holding current to hold the needle at the open position after supplying the open displacing current, the open state-holding current being smaller than the open displacing current, and the injector controller reduces a speed at which the needle moves from the open position to the close position, when the fuel injection period ends after supplying the open state-holding current, to a predetermined speed that is set such that the predetermined speed increases as an engine speed decreases.

8. The engine control device of claim 7, wherein the fuel injection is divided into a plurality of times including a last fuel injection, and the injector controller reduces the speed at which the needle moves from the open position to the close position only in the last fuel injection.

* * * * *